US005127809A

United States Patent [19]

Amata et al.

[11] Patent Number: 5,127,809

[45] Date of Patent: Jul. 7, 1992

[54] SCROLL COMPRESSOR WITH REINFORCING RIBS ON THE ORBITING SCROLL

[75] Inventors: Atushi Amata, Shizuoka; Takao Mizuno; Naoshi Uchikawa, both of Shimizu, all of Japan

[73] Assignee: Hitachi, Ltd., Tokyo, Japan

[21] Appl. No.: 639,333

[22] Filed: Jan. 10, 1991

[30] Foreign Application Priority Data

Feb. 21, 1990 [JP] Japan ..... 2-40762

[51] Int. Cl.[5] ..... F04C 18/04

[52] U.S. Cl. ..... 418/55.2; 418/55.5; 418/55.6; 418/151

[58] Field of Search ..... 418/55.2, 55.5, 55.6, 418/151

[56] References Cited

U.S. PATENT DOCUMENTS 4,472,120 9/1984 McCullough ..... 418/55.2

4,502,852 3/1985 Hazaki ..... 418/55.6

FOREIGN PATENT DOCUMENTS 58-110886 7/1983 Japan .

59-119091 7/1984 Japan .

60-233388 11/1985 Japan ..... 418/55.2

1-130081 5/1989 Japan ..... 418/55.6

*Primary Examiner*—John J. Vrablik

*Attorney, Agent, or Firm*—Antonelli, Terry, Stout & Kraus

[57] ABSTRACT

A scroll compressor comprising a housing, a frame, a fixed scroll and an orbiting scroll, arranged in the housing. Each of the fixed and orbiting scrolls have an end plate and a spiral wrap. A bearing boss is formed on the back surface of the end plate of said orbiting scroll. A plurality of radial ribs are formed on the back surface of the end plate of said orbiting scroll, with the radial ribs extending from the bearing boss to the marginal side of the end plate of said orbiting scroll.

3 Claims, 6 Drawing Sheets

SCROLL COMPRESSOR WITH REINFORCING RIBS ON THE ORBITING SCROLL

BACKGROUND OF THE INVENTION

1. Field of the Invention

The present invention relates to a scroll compressor for use as a refrigerant compressor for refrigerator, air conditioner or an air compressor, etc. and, particularly, more an arrangement for decreasing the weight and adjustment of balance of an orbiting scroll of a scroll compressor in order to assure the operation of the compressor at a high speed.

2. Description of the Prior Art

In conventional scroll compressors comprise a housing having a suction tube and a discharge tube, a frame fixedly mounted in the housing, a fixed scroll fixedly connected to the with frame and having an end plate, a spiral wrap upstanding from the end plate in the form of an involute or a nearly involute shape, and with a discharge port formed near the center of said end plate and a suction port formed at the peripheral portion of said end plate. An orbiting scroll is arranged in the frame for a revolving movement, with the orbiting scroll having an end plate and a spiral wrap upstanding from the end plate in the form of an involute or a nearly involute shape. The orbiting scroll and the fixed scroll are so arranged that their wraps are directed inward so as to mesh with each other.

A rotation inhibiting mechanism, such as Oldham mechanism, is arranged between the orbiting scroll and the frame to prevent the orbiting scroll from rotating about its own axis. A bearing boss is formed on the back surface of the end plate of the orbiting scroll. A drive shaft, driven by a motor, has an eccentric shaft portion which is held in engagement with the bearing boss.

By a revolving motion of the eccentric shaft portion, the orbiting scroll produces an orbiting motion, without producing rotation thereof about its own axis. Thus, a gas contained in a confined space formed by the orbiting scroll and the fixed scroll is successively compressed and the compressed gas is discharged from the discharge port.

Heretofore, the fixed scroll and the orbiting scroll have been made of cast iron, which has a relatively heavy weight. Accordingly, when the orbiting scroll is rotated at a high speed, the load on the bearing is increased to a centrifugal force acting on the orbiting scroll, thereby resulting in a lowering of the reliability of the compressor.

In order to enable the operation of the scroll compressor at higher speed, it has been proposed to decrease the weight of the orbiting scroll by making the orbiting scroll of a material having a low specific weight, such as aluminum alloy. Furthermore, it has been proposed to provide a construction in which asymmetrically arranged recesses are formed in the end plate of the orbiting scroll in order to locate the center of gravity of the orbiting scroll in alignment with the central axis of the bearing bass. Such a construction is shown in, for example Japanese Patent Application Laid-Open No. Sho 58-110886.

Furthermore, in order to prevent the increase of the load applied to the compressor due to compression of a fluid, such as a lubricating oil, which passes through the gap between the peripheral portion of the end plate of the orbiting scroll and the frame during a revolving of the orbiting scroll, it has been proposed to provide a construction in which grooves are formed in the surface of the frame adjacent to the peripheral portion of the end plate or small grooves are formed in a part of the peripheral portion of the end plate, whereby the fluid can easily pass through the gap. An example of such construction is shown in, for example Japanese Patent Application Laid-Open No. Sho 59-119091.

According to the prior art described above, if the orbiting scroll is made of a cast iron, which has a heavy weight, the load on the bearing owing to the centrifugal force of the orbiting scroll during operation at a high speed is increased, with the result that the reliability of the compressor is lowered. On the other hand, if the orbiting scroll is made of a metallic material having a low specific weight, such as aluminum alloy, it is necessary to provide relatively wide gaps at the tip ends of the wraps of fixed scroll and the orbiting scroll, since the fixed scroll and the frame made of cast iron and the orbiting scroll made of aluminum alloy have substantial difference in coefficient of thermal expansion, etc. Therefore, it is necessary to provide tip seals at the tip ends of the wraps in order to seal the confined compressing space.

In the construction heretofore proposed in which means are provided to locate the center of gravity of the orbiting scroll in alignment with the central axis of the bearing boss, such as shown in Japanese Patent Application No. Sho 58-110886 etc., no consideration is given to decreasing the weight of the orbiting scroll, which is necessary to operate the compressor at a high speed.

In the construction as shown in Japanese Patent Application Laid-Open No. Sho 59-119091, means are provided to prevent the increase of the load due to the compression of the fluid at the peripheral portion of the end plate of the orbiting scroll. However, no consideration is given to decreasing the weight of the orbiting scroll and locating the center of gravity of the orbiting scroll in substantial alignment with the central axis of the bearing boss, which is necessary to assure high speed operation of the compressor.

OBJECTS OF THE INVENTION

It is an object of the present invention to provide a scroll compressor in which the weight of the orbiting scroll is decreased, the increase of the load owing to the compression of the fluid at the peripheral portion of the end plate of the orbiting scroll is prevented, and the center of gravity of the orbiting scroll is located in substantial alignment with the central axis of the bearing boss.

SUMMARY OF THE INVENTION

In accordance with the present invention, a scroll compressor comprises a housing, a frame arranged in the housing, and a fixed scroll having an end plate and a spiral wrap upstanding from a surface of the end plate, with the end plate being connected, at its peripheral portion, onto the frame. An orbiting scroll arranged in opposed relation to said fixed scroll for a revolving movement with respect thereto with the orbiting scroll, having an end plate and a spiral wrap upstanding from a surface of said end plate, and with the end plate of the orbiting scroll being slidably sandwiched, at its peripheral portion, between the peripheral portion of the fixed scroll and the frame. The fixed scroll and the orbiting scroll are arranged so that their wraps are directed inward to make them mesh with each other. A back pressure chamber is formed between a back surface of the end plate of the orbiting scroll and the frame to press the orbiting scroll toward the fixed scroll under the action of a fluid pressure fed into the back pressure chamber. Rotation inhibiting means are arranged between the frame and the orbiting scroll to inhibit rotation of the orbiting scroll about its own axis while allowing orbiting revolution thereof. A bearing boss is formed on the back surface of the end plate of the orbiting scroll, with a drive shaft driving the orbiting scroll. The drive shaft has an eccentric shaft portion engageable with the bearing boss to cause the orbiting motion of the orbiting scroll. A plurality of radial ribs are formed on the back surface of the end plate of the orbiting scroll, with the plurality of ribs extending from the bearing boss to the marginal side of the end plate of the orbiting scroll.

According to the invention, the radial ribs form recessed portions therebetween, which communicate an area outside of the marginal side of the end plate of the orbiting scroll with the back pressure chamber.

According to further features of the invention, the ribs are formed, at their marginal ends, with a seat extending in the peripheral direction of the orbiting scroll.

According to still further features of the invention, the seat is formed with slots or holes which communicate the area outside of the seat with the recessed portions formed between the radial ribs, and the recessed portions formed between the radial ribs communicate with the back pressure chamber.

According to additional features of the invention, the depths of the recessed portions formed between the radial ribs are so adjusted that the center of gravity of the orbiting scroll is positioned substantially on the central axis of the bearing boss.

According to the invention, the width of the seat is so adjusted that the center of gravity of the orbiting scroll is positioned substantially on the central axis of the bearing boss.

According to the present invention as described above, the radial ribs extend substantially at right angle to the spiral wrap of the orbiting scroll, whereby a relatively rigid construction of the orbiting scroll is obtained, so that the thickness of the end plate can be reduced and thus the weight of the orbiting scroll can be decreased.

The center of gravity of the orbiting scroll can be located in substantial alignment with the central axis of the bearing boss, by adjusting the depths of the recesses formed between the radial ribs or adjusting the width of the seat formed at the peripheral portion of the end plate. As the result, the effect of the centrifugal force of the orbiting scroll can be reduced and the vibration of the scroll compressor can be reduced, so that the compressor can be operated at higher speed.

Furthermore, the recesses formed between the radial ribs constitute lubricant oil passages which communicate the marginal side of the end plate of the orbiting scroll with the back pressure chamber, so that the compression of the lubricant oil is prevented even where the marginal side of the peripheral portion of the end plate of the orbiting scroll comes close to an inside surface opposite thereto of the frame during revolution and thus the power consumption of the compressor can be reduced.

BRIEF DESCRIPTION OF THE DRAWINGS

The accompanying drawings illustrate the preferred embodiments of the present invention, in which.

DETAILED DESCRIPTION OF THE PREFERRED EMBODIMENTS

Now, the present invention will be explained, with reference to the preferred embodiments illustrated in the accompanying drawings.

Firstly, the embodiment illustrated in FIGS. 1-5 will be explained.

Figure 1:
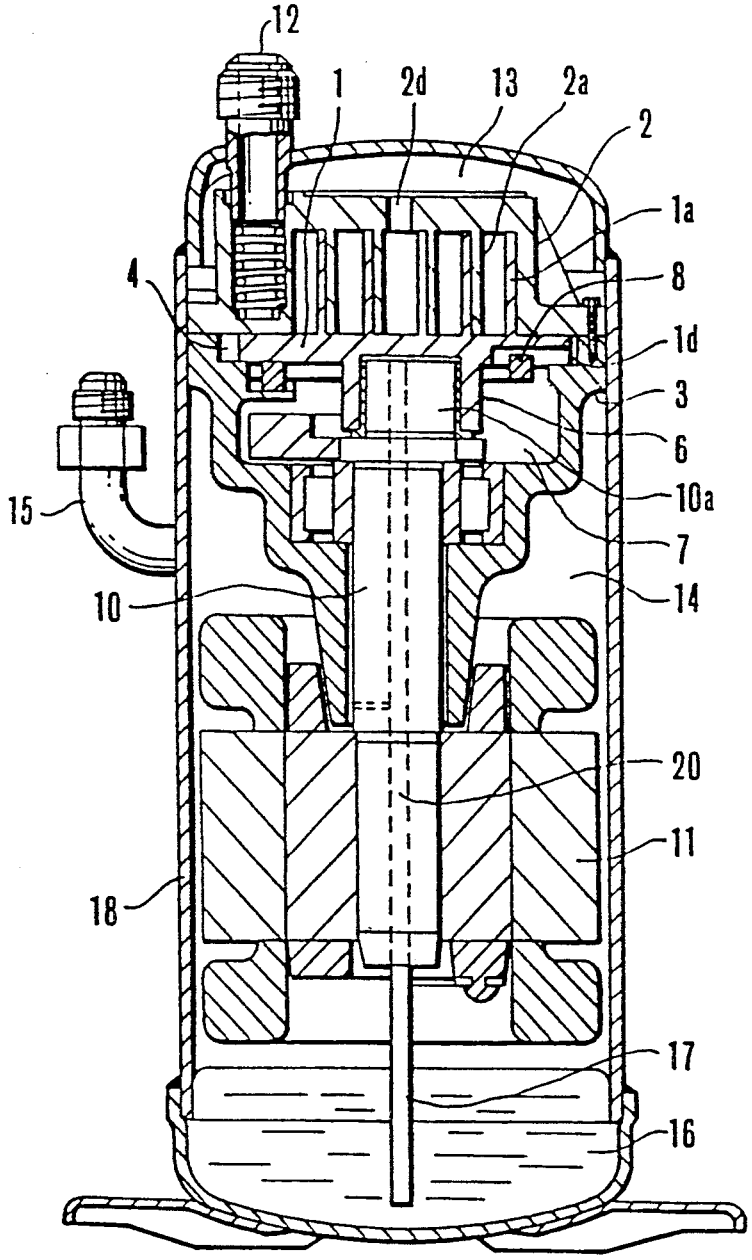
FIG. 1 is a longitudinal sectional view of one embodiment of the scroll compressor according to the present invention.
Figure 5:
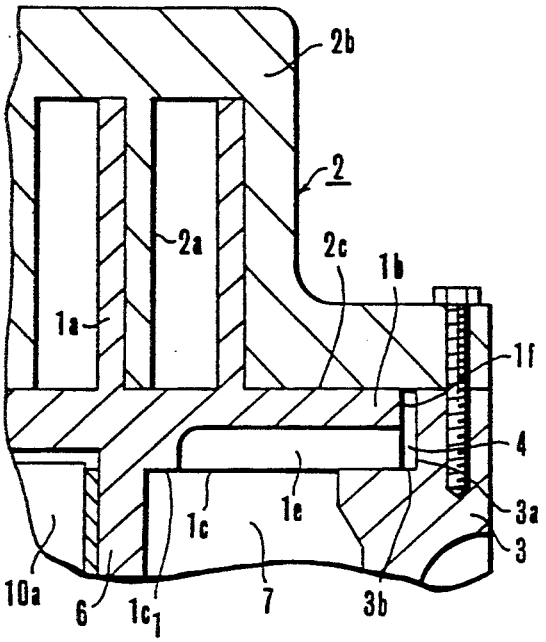
FIG. 5 is an enlarged sectional view, showing the relation between the orbiting scroll and the fixed scroll of the embodiment shown in FIG. 1.

The scroll compressor shown in FIG. 1 includes an orbiting scroll 1 having a spiral wrap 1*a* and a fixed scroll 2 having a similar spiral wrap 2*a*. The orbiting scroll and the fixed scroll 2 are arranged in meshing relationship with each other, thereby constituting a compressing part. The fixed scroll 2 is connected with a frame 3 and fixedly mounted in a sealed housing 18. The orbiting scroll 1 has an end plate, which is slidably sandwiched at its peripheral portion between a surface 2*c* of an end plate 2*b* of the fixed scroll 2 and a surface 3*b* of the frame 3, with small gaps (not shown) being maintained therebetween, as shown in FIG. 5. A bearing boss 6 is formed on the back side of the end plate of the orbiting scroll A drive shaft 10 has an eccentric shaft portion, namely, a crank pin 10*a*, which is in bearing engagement with the boss 6. A motor 11, which is mounted in the housing 18, serves to rotate the drive shaft 10, whereby the orbiting scroll 1 produces an orbiting motion relative to the fixed scroll 2, while the rotation of the orbiting scroll about its own axis is prevented by the Oldham mechanism 8. As the orbiting scroll 1 produces the orbiting motion relative to the fixed scroll 2, a gas is introduced through a suction pipe 12 into a compressing chamber formed between the wraps of the scrolls 1, 2 and is gradually compressed as the volume of the compressing chamber is reduced. The compressed gas is discharged through the central discharge port 2*d* of the fixed scroll into an upper discharge chamber 13 and then the gas is passed through a motor chamber 14, positioned underside of the compressor, and discharged through a discharge pipe 15 to the outside of the compressor. During operation, the gas, at an intermediate pressure, between the suction pressure and the discharge pressure, is introduced into the back pressure chamber 7 enclosed by the orbiting scroll and the frame 3, and such intermediate pressure acts on the back surface of the orbiting scroll 1, thereby generating a pressing force to press the orbiting scroll 1 toward the fixed scroll 2 in axial direction. Preferably, the introduction of such intermediate pressure is effected by passing the gas, under a compressing process between the wraps of the both scrolls, into the back pressure chamber 7 through small holes (not shown) formed through the end plate of the orbiting scroll. During operation, the lubricant oil is fed from an oil reservoir 16 at the bottom in the sealed container 18, through a feeding pipe 17 and a feeding bore 20 formed in the drive shaft 10, to bearings for the drive shaft 10 supported by the frame 3 and to a bearing inserted in the boss 6 of the orbiting scroll. The lubricant oil also serves to lubricate the Oldham mechanism 8 and, furthermore, it passes from the back pressure chamber 7 through a space 4 formed between a marginal side 1*f* of the end plate of the orbiting scroll 1 and an inner side 3*a* opposite thereto of the frame 3 into the compressing chamber between the both scrolls, thereby lubricating the sliding surfaces of the orbiting scroll confronting the frame 2 and the fixed scroll 2. Then, the lubricant oil is discharged, together with the gas, into the discharge chamber 13. The gas discharged with the oil into the discharge chamber 13 is passed through the motor chamber 14 and a part of the lubricant oil is returned into the reservoir 16 and the other part of the lubricant oil is discharged, together with the gas, through the discharge pipe 15 to the outside of the compressor.

Figure 2:
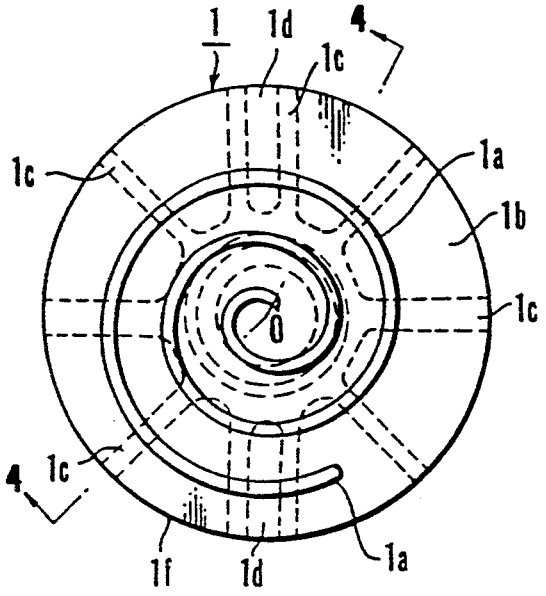
FIG. 2 is a plan view of an example of the orbiting scroll for the scroll compressor according to the present invention, as viewed from the wrap side.
Figure 4:
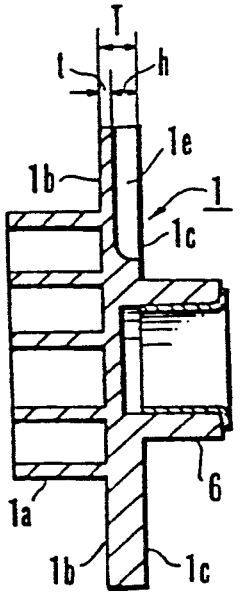
FIG. 4 is a sectional view taken along a line 4-0-4 in FIG. 2.
Figure 3:
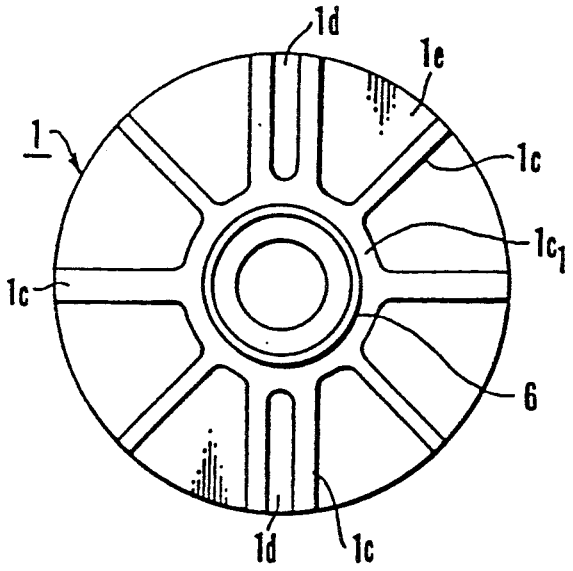
FIG. 3 is a plan view of the orbiting scroll shown in FIG. 2, as viewed from the back side thereof.

As shown in FIG. 2, FIG. 3 and FIG. 4, the end plate 1*b* of the orbiting scroll 1 is formed with radial ribs 1*c* on the surface opposite to the surface on which the spiral wrap 1*a* is formed. The radial ribs 1*c* include a plurality of ribs which radially extend from the boss 6, which receives the eccentric shaft portion, namely, the crankpin 10*a* of the drive shaft 10, to the peripheral portion of the end plate 1*b*. Some of the radial ribs are arranged, in pairs, to form Oldham keyways.

Referring to FIG. 4, T indicates the sum of the thickness t of the end plate and the height h of the radial rib 1*c*, namely, the depth of the recess 1*e* formed between the radial ribs, which is constant. As shown in FIG. 5, the end plate of the orbiting scroll is slidably sandwiched between the surface 3*b* of the frame 3 and the surface 2*c* of the end plate 2*b* of the fixed scroll, with small gaps (not shown) being maintained between the top surface of the radial rib 1*c* and the surface 3*b* of the frame 3.

As shown in FIG. 2, the plurality of radial ribs 1*c* extend substantially at a right angle to the spiral wrap 1*a*, thereby forming a rigid construction of the orbiting scroll, so that the thickness of the end plate 1*b* can be reduced, as compared to the conventional construction and thus the weight of the orbiting scroll can be reduced.

The recesses 1*e* formed between the radial ribs 1*c* extend to the marginal side 1*f* of the end plate 1*b* and constitute lubricant oil passages which communicate the area outside of the marginal side 1*f* of the orbiting scroll, that is the space 4, with the back pressure chamber 7. Accordingly, the surface area of the marginal side 1*f* of the end plate is reduced, and passages are formed through which the lubricating oil can easily pass even when the marginal side 1*f* of the end plate comes near the inside surface 3*a* of the frame 3, as shown in FIG. 5. Therefore, the lubricant oil is not compressed by the marginal side of the end plate and, thus, the increase of load due to the compression of the lubricant oil is avoided.

In the above construction, it is possible to locate the center of gravity of the orbiting scroll 1, as viewed in the plan view, in alignment with the central axis 0 of the bearing boss 6, by adjusting the thicknesses of the end plate 1*b* at the positions between the radial ribs 1*c*, namely, the depths of the recesses 1*e* formed between the radial ribs.

Figure 6:
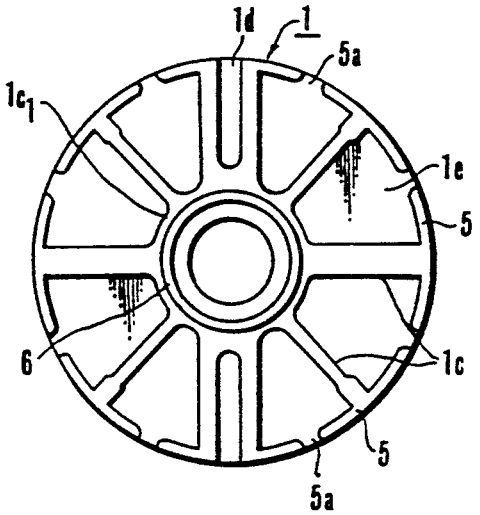
FIG. 6 shows another example of the orbiting scroll for the scroll compressor according to the present invention.

FIG. 6 illustrates an example of the orbiting scroll in which the surface area of the peripheral portion of the end plate of the orbiting scroll to contact with the surface 3*b* of the frame 3 is increased, with the object of decreasing the surface pressure at which the end plate of the orbiting scroll is pressed against the surface 3*b* of the frame 3 by the gas pressure at the time of starting of the compressor. In this example, a seat 5 having a height equal to that of the radial rib 1*c* is formed on the entire circumference of the end plate and said seat is partly cut to form small slots 5*a*, which communicate the area outside of the seat 5 with the respective recesses 1*e*.

Figure 7:
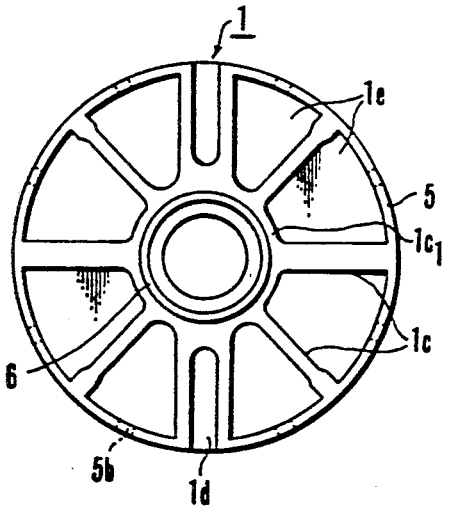
FIG. 7 shows a further example of the orbiting scroll for the scroll compressor according to the present invention.
Figure 8:
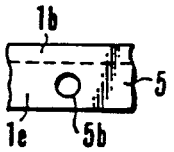
FIG. 8 is a partial side view of the orbiting scroll shown in FIG. 7.

FIG. 7 and FIG. 8 illustrate another example, in which small holes 5*b* are formed in the seat 5 at several parts thereof, in place of the slots as shown in FIG. 6. The small holes 5*b* communicate the area outside of the seat 5 with the respective recesses 1*e*.

Figure 9:
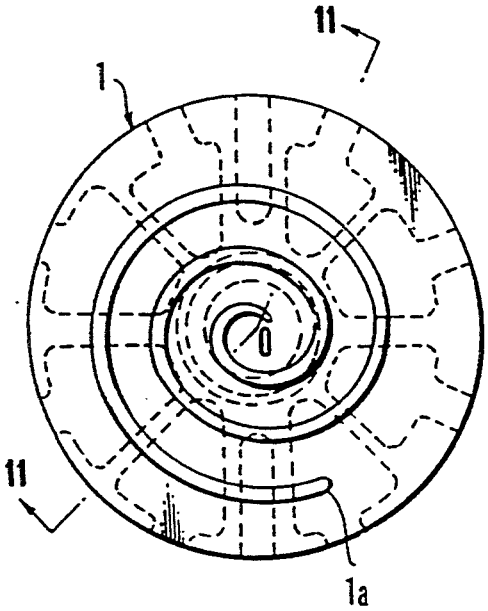
FIG. 9 is a plan view of another embodiment of the orbiting scroll according to the present invention, as viewed from the wrap side.
Figure 11:
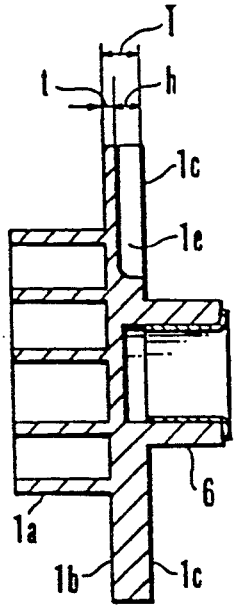
FIG. 11 is a sectional view taken along a line 11-0-11 in FIG. 9.
Figure 10:
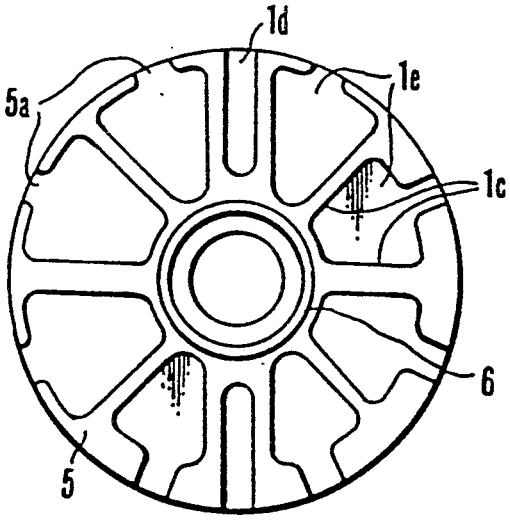
FIG. 10 is a plan view of the orbiting scroll shown in FIG. 9, as viewed from the back side thereof.

In the example shown in FIGS. 9, 10 and 11, the radial ribs 1*c* are formed on the side of the the end plate 1*b* of the orbiting scroll 1 opposite to the side on which the wrap 1*a* is formed. The radial ribs 1*c* are formed with the bearing boss 6. The end plate 1*b* has a constant thickness at the portions between these ribs 1*c* and recesses 1*e* are formed between the ribs 1*c*. The radial ribs 1*c* are arranged substantially at right angle to the wrap 1*a*, so that high rigidity of the orbiting scroll 1 is obtained, regardless of the thin thickness of the end plate 1*b*, and the weight of the orbiting scroll 1 can be reduced. The forward end portion of the radial rib 1*c* is integrally connected with the seat 5 which extends in circumferential direction on the peripheral portion of the end plate 1*b*. The seat 5 forms a contact surface contacting the surface 3*b* of the frame 3. The center of gravity of the orbiting scroll 1 can be located in alignment with the central axis 0 of the boss 6, by adjusting the width and consequently, the contact area, of the seat 5.

In order to avoid the power loss which may be caused by agitation and/or compression of the lubricant oil in the space 4 (shown in FIG. 12) between the marginal side 1*f* of the end plate of the orbiting scroll and the inside surface 3*a* of the frame 3, the seat 5 is formed with cut portions 5*a* which communicate the space 4 outside of the marginal side of the end plate of the orbiting scroll 1 with the recesses 1*e* formed between the radial ribs, whereby the area of the seat 5 on the peripheral portion of the end plate 1*b* of the orbiting scroll is reduced and, lubricant oil passages are formed to communicate the space 4 outside of the marginal side 1*f* of the end pate of the orbiting scroll with the back pressure chamber 7 through the cut portions 5*a* and said recesses 1*e*. The sum T of the height h of the radial rib 1*c*, equal to the height of the seat 5 plus the thickness t of the end plate at the positions between the radial ribs 1*c* is slightly smaller than the distance between the surface 2*c* of the fixed scroll 2 and the surface 3*b* of the frame 3, so that the end plate of the orbiting scroll is sandwiched between the surfaces 2*c* and 3*b*, with small gaps therebetween.

Figure 13:
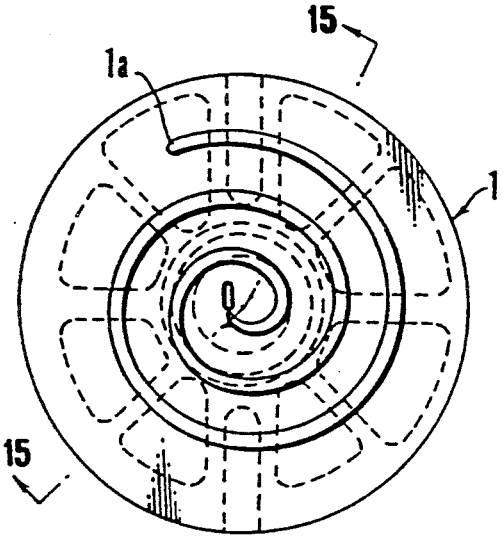
FIG. 13 is a plan view of another embodiment of the orbiting scroll according to the present invention, as viewed from the wrap side.
Figure 15:
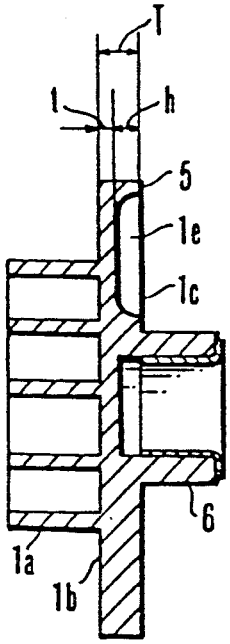
FIG. 15 is a sectional view taken along a line 15-0-15 in FIG. 13.
Figure 14:
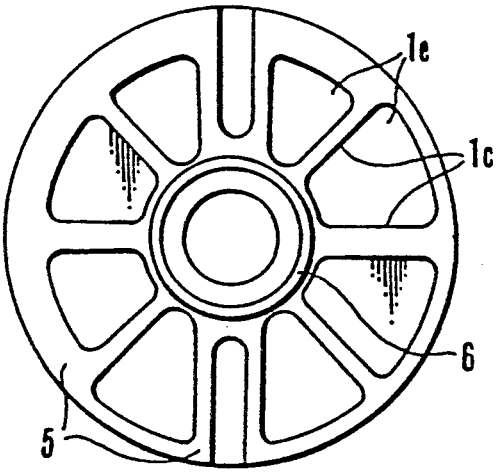
FIG. 14 is a plan view of the orbiting scroll as shown in FIG. 13, as viewed from the back side thereof.

FIG. 13, FIG. 14 and FIG. 15 illustrate an embodiment in which the contact seat 5 which contacts with the frame 3, as shown in FIGS. 9, 10 and 11, is formed as a continuous part extending in peripheral direction, thereby further increasing the rigidity of the orbiting scroll.

Figure 16:
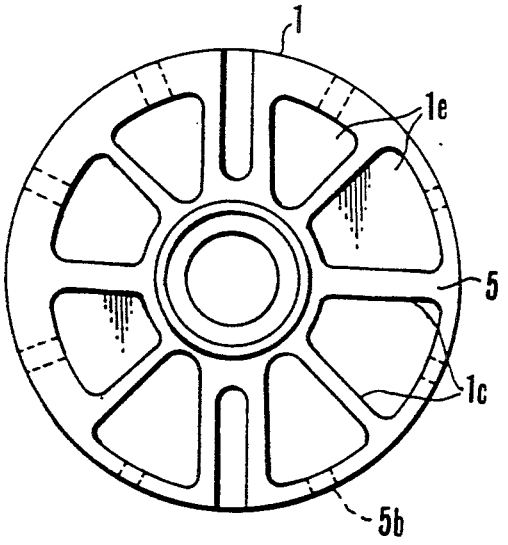
FIG. 16 is a plan view of a further embodiment of the orbiting scroll according to the present invention, as viewed from the back side thereof.
Figure 17:
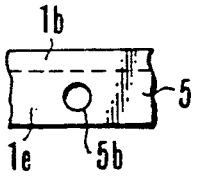
FIG. 17 is a partial side view of the orbiting scroll shown in FIG. 16.

FIG. 16 and FIG. 17 illustrate an embodiment in which the seat 5 is formed with through-holes 5*b*, which constitute passages of the lubricant oil for communicating the space 4 outside of the marginal side of the end plate of the orbiting scroll 1 with the back pressure chamber 7, as in the embodiment shown in FIGS. 9, 10 and 11.

According to the present invention, the weight of the orbiting scroll 1 is reduced by decreasing the thickness of entire end plate 1*b* excluding the ribs 1*c* and the seat 5. Accordingly, the centrifugal force due to the weight of the orbiting scroll itself during the operation of the compressor at a high speed can be minimized, so that the bearing load can be reduced, thereby resulting in an improvement in the reliability of the compressor. Although the thickness of the end plate is decreased, the rigidity of the orbiting scroll is not lowered, due to the existence of the radial ribs 1*c* which extend at right angle to the spiral wrap 1*a*.

In the embodiments as shown in FIGS. 2, 3 and 4, FIG. 6 and FIGS. 7 and 8, the center of gravity of the orbiting scroll 1 is adjusted by adjusting the depths of the recesses formed between the radial ribs 1*c*, so that said center of gravity is located in alignment with the central axis of the boss 6. In the embodiments as shown in FIGS. 9, 10 and 11, FIGS. 13, 14 and 15 and FIGS. 16 and 17, the same adjustment of the center of gravity of the orbiting scroll is effected by adjusting the contacting area or width of the contact seat 5. By the adjustment of the center of gravity of the orbiting scroll, the occurrence of an unstable revolution of the orbiting scroll 1 can be avoided, whereby the occurrence of non-uniform contact between the relatively sliding parts, such as between the drive shaft and the bearing, can be avoided, and the generation of vibration and noise can be reduced.

Figure 12:
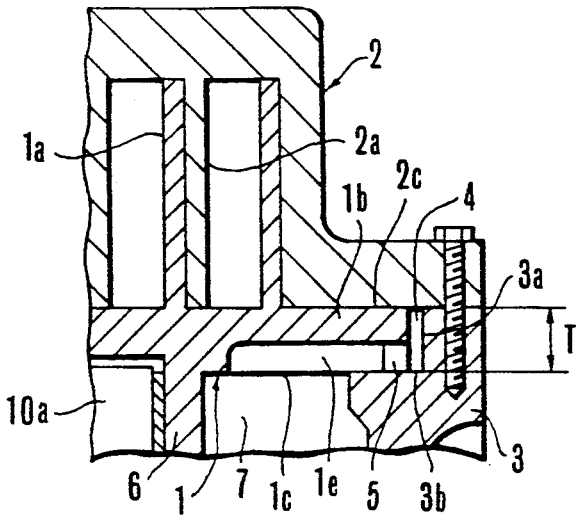
FIG. 12 is a partial enlarged sectional view showing the orbiting scroll shown in FIGS. 9, 10 and 11, as combined with the fixed scroll and the frame.

Even when the space 4 is narrowered by the marginal side 1*f* of the end plate of the orbiting scroll 1 approaching the inside surface 3*a* of the frame 3, as shown in FIG. 5 or FIG. 12 the lubricant oil can flow out of the space, through the recesses 1*b* formed between the radial ribs 1*c*, in the embodiment shown in FIGS. 2, 3 and 4, or the recesses 1*e* between the radial ribs and the cut portions 5*a* or the holes 5*b*, in the embodiments shown in FIG. 6, FIGS. 7 and 8, FIGS. 9, 10 and 11 and FIGS. 16 and 17. Accordingly, an increase of the power consumption, caused by agitation and/or compression of the lubricant oil, can be avoided.

A further difference is noted between the conventional scroll compressor and that of the present invention. In general, the orbiting scroll of the scroll compressor tends to move away from the fixed scroll due to the thrust force caused by the pressure of the compressed gas during operation of the scroll compressor. According to the conventional type scroll compressor, the orbiting scroll tending to move away from the fixed scroll by the thrust force is supported by the frame, while according to the present invention the fluid pressure introduced into the back pressure chamber acts on the back side of the end plate of the orbiting scroll, thereby pressing the orbiting scroll toward the fixed scroll against the thrust force applied to the orbiting scroll. Therefore, in the scroll compressor according to the present invention, it is unnecessary to support the orbiting scroll by the frame during operation of the compressor, and it is only required to support the orbiting scroll by the frame only at the starting the compressor or when the compressor is stopped where the gas is at a low pressure. Thus, the provision of a small supporting area, such as the seat 5 or the ribs 1*c*, is enough to support the the orbiting scroll on the frame at the time of starting or stopping the compressor.

It is not always necessary to form an annular portion $1c_1$, which connects together the inner ends of the radial ribs 1*c*, and the radial portions of the radial ribs 1*c* may be so constructed that they extend directly from the bearing boss 6 in radial directions.

By virtue of the features of the present invention, the weight of the orbiting scroll can be considerably reduced, so that the centrifugal force caused by the orbiting scroll itself during operation of the compressor at a high speed is lowered and, consequently, the load on the bearing portions is reduced, thereby resulting in improving the reliability of the scroll compressor.

In the scroll compressor according to the present invention, the weight of the orbiting scroll can be reduced due to the construction and the shape of the orbiting scroll. Accordingly, the reduction of the weight of the orbiting scroll is possible even if the orbiting scroll is made of cast iron, and thus it is possible to avoid the problem arising due to the difference in coefficient of thermal expansion between the fixed scroll and the orbiting scroll if the orbiting scroll is made of aluminum alloy.

Furthermore, it is possible to locate the center of gravity of the orbiting scroll on the central axis of the bearing boss by adjusting the thicknesses of the end plate at the areas between the radial ribs, namely, the depths of the recesses formed between the radial ribs or adjusting the width of the contact seat formed on the peripheral portion of the end plate, and thus, the occurrence of unstable revolution of the orbiting scroll is avoided, so that the occurrence of non-uniform contact between the relatively sliding parts and the generation of noise are reduced.

The lubricant oil in the space between the marginal side of the end plate of the orbiting scroll and the inside surface of the frame can flow out of the space through the recesses formed between the radial ribs when the marginal side of the end plate comes close to the inside surface of the frame. Accordingly, the increase of load which may be caused by the compression of the lubricant oil in the space can be avoided.

What is claimed is:

1. A scroll compressor, comprising:

a housing;

a frame arranged in said housing;

a fixed scroll having an end plate and a spiral wrap upstanding from a surface of said end plate, said end plate being connected at a peripheral portion thereof to said frame;

an orbiting scroll arranged in an opposed relationship to said fixed scroll and being adapted to revolve with respect to the fixed scroll, said orbiting scroll having an end plate and a spiral wrap upstanding from a surface of said end plate, said end plate of said orbiting scroll being slidably sandwiched, at a peripheral portion thereof, between the peripheral portion of said fixed scroll and said frame, said fixed scroll and said orbiting scroll being arranged so that the wraps of the fixed and orbiting scrolls are directed toward one another and intermesh;

a back pressure chamber formed between a back surface of the end plate of said orbiting scroll and said frame to press the orbiting scroll toward the fixed scroll by a fluid pressure fed into said back pressure chamber;

rotation inhibiting means arranged between said frame and said orbiting scroll for inhibiting rotation of the orbiting scroll about its own axis while allowing an orbiting motion thereof;

a bearing boss formed on the back surface of the end plate of said orbiting scroll;

a drive shaft for driving said orbiting scroll, said drive shaft having an eccentric shaft portion for engagement with said bearing boss to cause the orbiting motion of said orbiting scroll; and a plurality of radial ribs formed on the back surface of the end plate of said orbiting scroll, said plurality of ribs extending from said bearing boss to the peripheral portion of said end plate of said orbiting scroll, and wherein recessed portions are formed between the radial ribs, said recessed portions reducing a thickness of said end plate of said orbiting scroll member such that a center of gravity of said orbiting scroll is positioned substantially on a central axis of said bearing boss.

2. A scroll compressor comprising:

a housing;

a frame arranged in said housing;

a fixed scroll having an end plate and a spiral wrap upstanding from a surface of said end plate, said end plate being connected, at a peripheral portion thereof to said frame;

an orbiting scroll arranged in an opposed relationship to said fixed scroll and being adapted to revolve with respect to the fixed scroll, said orbiting scroll having an end plate and a spiral wrap upstanding from a surface of said end plate, said end plate of said orbiting scroll being slidably sandwiched, at a peripheral portion thereof, between the peripheral portion of said fixed scroll and said frame, said fixed scroll and said orbiting scroll being arranged so that the wraps of the fixed and orbiting scrolls are directed toward one another and intermesh;

a back pressure chamber formed between a back surface of the end plate of said orbiting scroll and said frame to press the orbiting scroll toward the fixed scroll by a fluid pressure fed into said back pressure chamber;

rotation inhibiting means arranged between said frame and said orbiting scroll for inhibiting rotation of the orbiting scroll about its own axis while allowing an orbiting motion thereof;

a bearing boss formed on the back surface of the end plate of said orbiting scroll;

a drive shaft for driving said orbiting scroll, said drive shaft having an eccentric shaft portion for engagement with said bearing boss to cause the orbiting motion of said orbiting scroll;

a plurality of radial ribs formed on the back surface of the end plate of said orbiting scroll, said plurality of ribs extending from said bearing boss to the peripheral portion of said end plate of said orbiting scroll, said seat having a width such that a center of gravity of said orbiting scroll is positioned substantially on the central axis of said bearing boss.

3. A scroll compressor comprising:

a housing;

a frame arranged in said housing:

a fixed scroll having an end plate and a spiral wrap upstanding from a surface of said end plate, said end plate being connected, at a peripheral portion thereof, to said frame;

an orbiting scroll arranged in an opposed relationship to said fixed scroll and being adapted to revolve with respect to the fixed scroll, said orbiting scroll having an end plate and a spiral wrap upstanding from a surface of said end plate, said end plate of said orbiting scroll being slidably sandwiched, at a peripheral portion thereof, between the peripheral portion of said fixed scroll and said frame, said fixed scroll and said orbiting scroll being arranged so that the wraps of the fixed and orbiting scrolls are directed toward one another and intermesh;

a back pressure chamber formed between a back surface of the end plate of said orbiting scroll and said frame to press the orbiting scroll toward the fixed scroll by a fluid pressure fed into said back pressure chamber;

rotation inhibiting means arranged between said frame and said orbiting scroll for inhibiting rotation of the orbiting scroll about its own axis while allowing an orbiting motion thereof;

a bearing boss formed on the back surface of the end plate of said orbiting scroll;

a drive shaft for driving said orbiting scroll, said drive shaft having an eccentric shaft portion for engagement with said bearing boss to cause the orbiting motion of said orbiting scroll;

a plurality of radial ribs formed on the back surface of the end plate of said orbiting scroll, said plurality of ribs extending from said bearing boss to the peripheral portion of said end plate of said orbiting scroll;

a seat formed at marginal ends of said plurality of ribs, said seat extending in a peripheral direction of said orbiting scroll and being formed wit one of slots or holes communicating an area outside of the seat with recessed portions formed between said radial ribs, said recessed portions communicating with said back pressure chamber, and wherein said seat has a width such that a center or gravity of said orbiting scroll is positioned substantially on a central axis of said bearing boss.

* * * * *